175-50 SR
8/23/77 OR 4,043,407

United States Patent [19]

Wilkins

[11] 4,043,407

[45] Aug. 23, 1977

[54] DRILLING SAMPLING/TESTING EQUIPMENT

[75] Inventor: John William Wilkins, Hounslow, England

[73] Assignee: Taywood Seltrust Offshore, England

[21] Appl. No.: 655,982

[22] Filed: Feb. 6, 1976

[30] Foreign Application Priority Data

Feb. 6, 1975 United Kingdom ..... 5173/75

[51] Int. Cl.[2] ..... E21B 7/12; E21C 1/00

[52] U.S. Cl. ..... 175/50; 175/6; 175/51; 175/58; 175/20; 73/84; 175/52

[58] Field of Search ..... 175/6, 52, 20, 244, 175/51, 50, 248, 58; 73/151, 84

[56] References Cited

U.S. PATENT DOCUMENTS

| | | | |
|---|---|---|---|
| 3,481,188 | 12/1969 | Mori | 73/84 |
| 3,500,678 | 3/1970 | Van Romond Vis | 73/151 X |
| 3,502,159 | 3/1970 | Pogonowski | 175/6 |
| 3,670,830 | 6/1972 | Van der Widjen | 175/52 |
| 3,701,387 | 10/1972 | Koot | 175/20 X |
| 3,741,320 | 6/1973 | Hilfing | 175/52 |
| 3,906,781 | 9/1975 | Vlasblom | 73/84 |

*Primary Examiner*—Ernest R. Purser
*Assistant Examiner*—Richard E. Favreau
*Attorney, Agent, or Firm*—Armstrong, Nikaido & Marmelstein

[57] ABSTRACT

Equipment for drilling and obtaining samples from, and/or testing at, locations where the soil being investigated is unstable, or where access to the equipment is difficult during drilling, for example underwater. Samples can be obtained, or tests carried out, at several depths in one bore hole by the employment of equipment, including a drill, a plurality of sample receivers and a testing means mounted to enter a bore with the drill and including a first means for operating the sample receiver, a second means to operate the testing means, and a third means arranged to be actuated in dependence upon the sample receiver.

8 Claims, 7 Drawing Figures

DRILLING SAMPLING/TESTING EQUIPMENT

This invention relates to drilling and sampling/testing equipment, and is particularly concerned with equipment for drilling and obtaining samples from, or testing at, locations where the soil being investigated is unstable, or where access to the equipment is difficult during drilling, for example underwater. Such equipment can be used, for example, to obtain information on sea bed conditions at locations where structures such as drilling platforms are to be sited, or where pipelines are to be layed.

It is preferable that the samples obtained should be in as relatively undisturbed a condition as possible, and it is also preferable in some cases if testing can be carried out at the drilling location. In previously proposed equipment operating in shallow bore holes, cutting tools used to deepen the bore hole are withdrawn before inserting sampling or in-situ testing tools. In deeper bore holes cutting tools can also be withdrawn entirely before inserting the sampling tubes, or by using so called "wire-line" techniques a portion of the cutting tool withdrawn and a sampling tool temporarily inserted.

According to the present invention there is provided drilling and sampling and/or testing equipment comprising a drill; a plurality of sample receivers and/or testing means mounted for entering with the drill a bore being drilled by the drill and movable so as successively to be disposed at a sampling/testing station; first means, for operating that sample receiver or testing means disposed at said station to obtain a sample therein or to effect testing; and second means, arranged to be actuated in dependence upon sample receiver/testing means operation effected by said first means to move the so-operated sample receiver with its obtained sample, or the so-operated testing means after testing, away from said station and to move the next successive sample receiver or testing means to said station whereby samples can be obtained or tests effected by successive sample receivers or testing means at successive levels in a bore hole during drilling of the bore hole.

Figure 1:
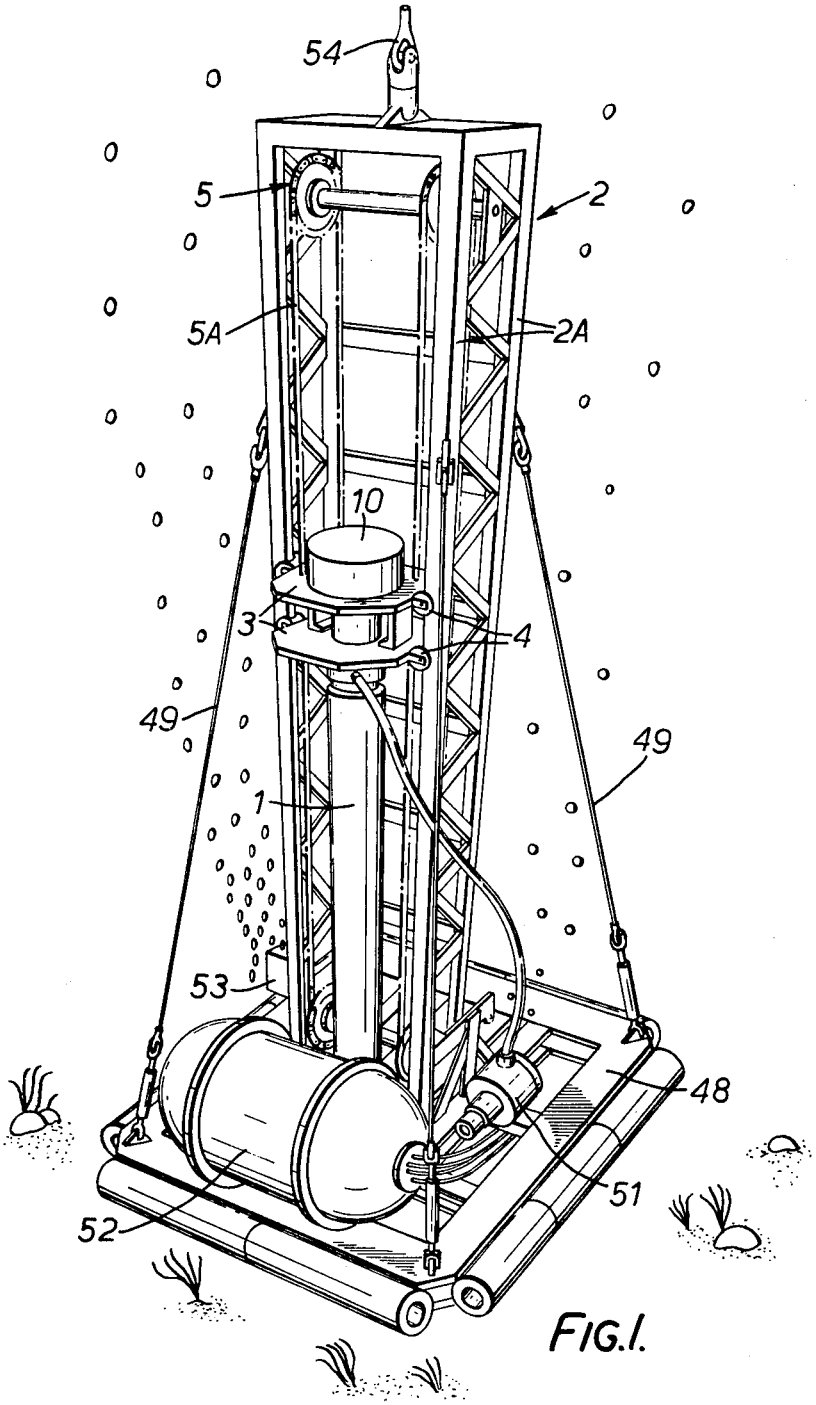
Figure 2:
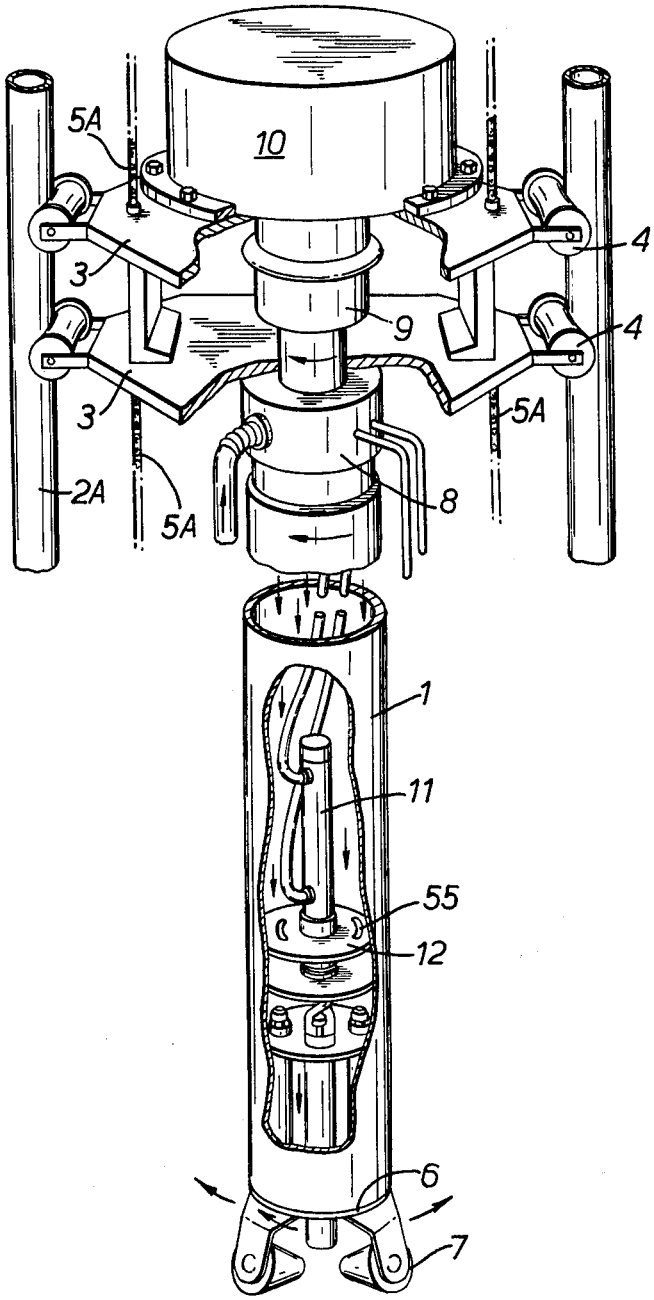
Figure 3:
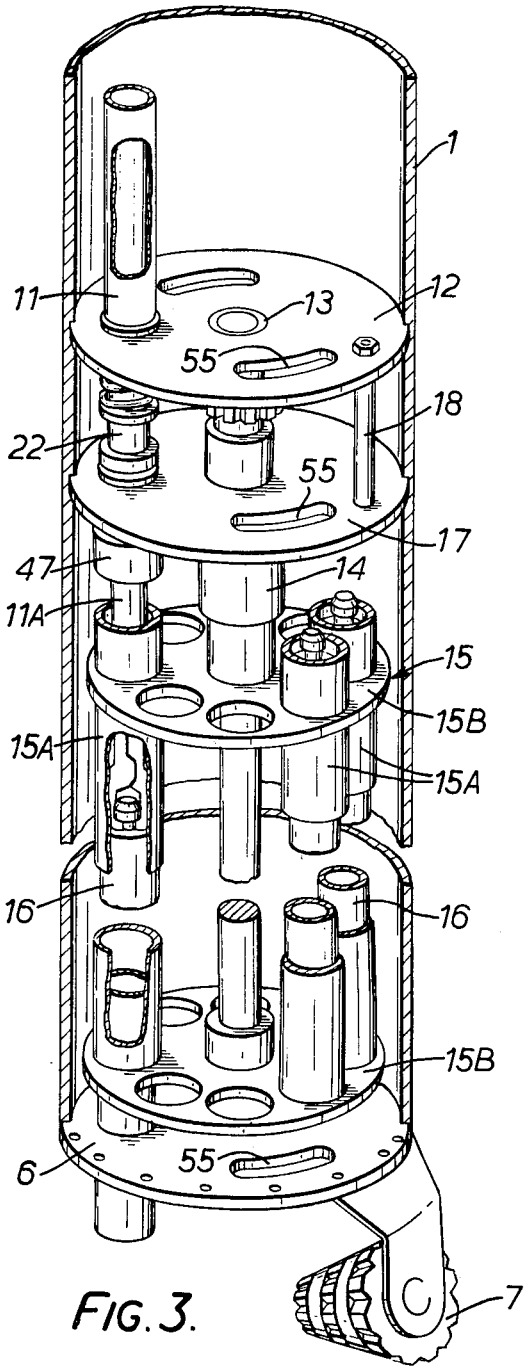
Figure 4:
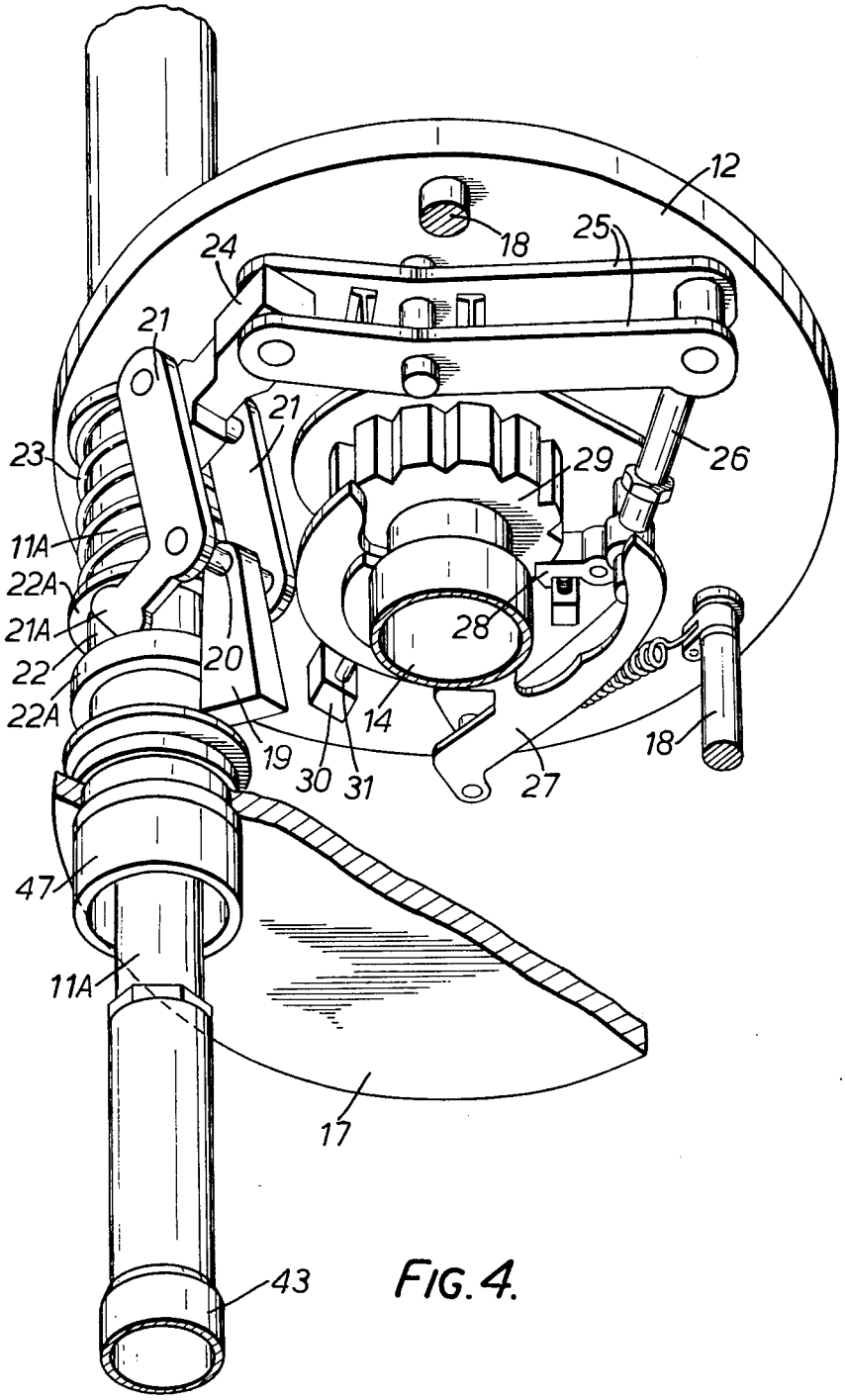
Figure 5:
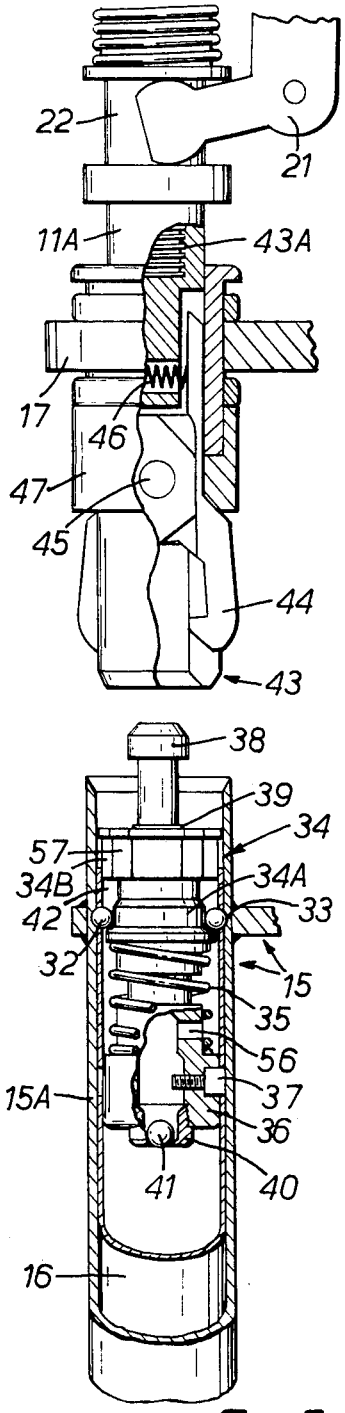
Figure 6:
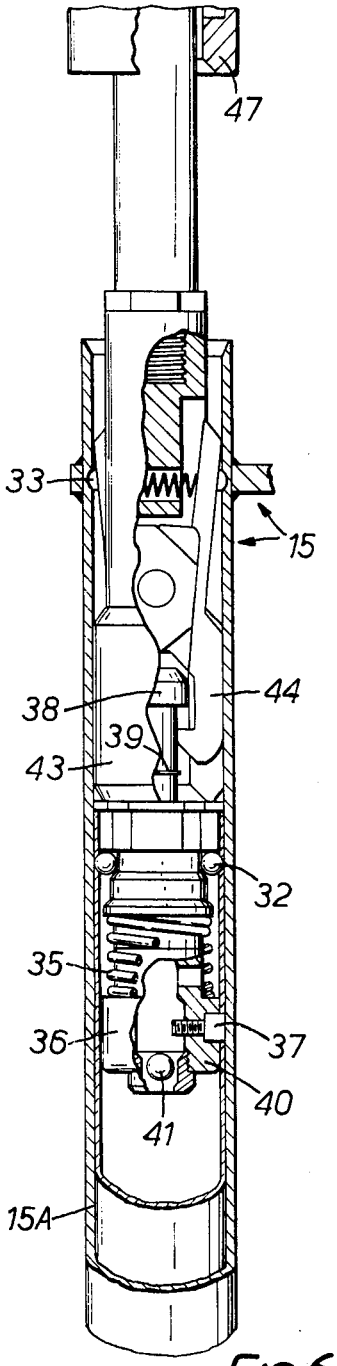
Figure 7:
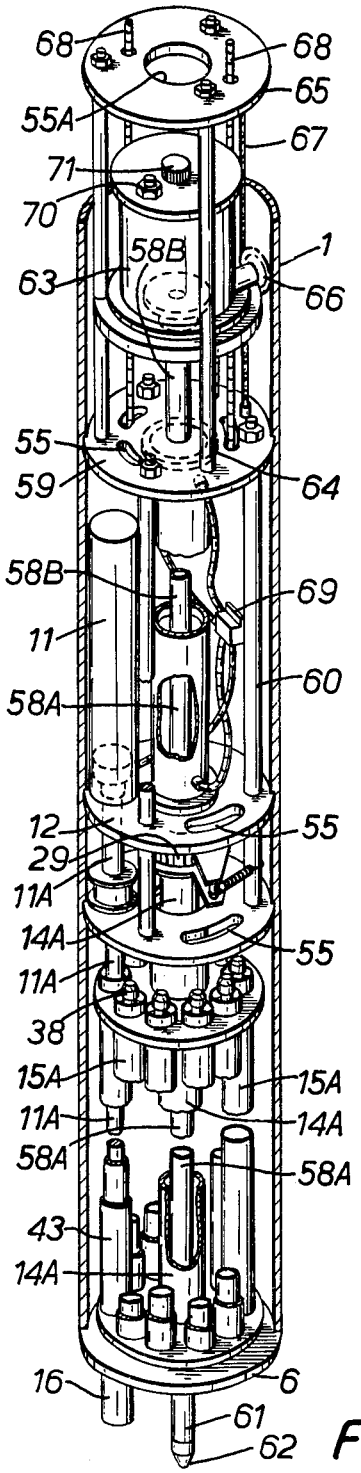

For a better understanding of the invention and to show how the same may be carried into effect, reference will now be made, by way of example, to the accompanying drawings, in which:

FIG. 1 is a perspective view of drilling and sampling equipment,

FIG. 2 is a perspective view, partly broken away and on a larger scale than FIG. 1, of components of the equipment of FIG. 1, FIG. 3 is a perspective view showing the interior of one of the components of FIG. 2, drawn to a larger scale, FIG. 4 is a perspective view from a different viewpoint of a detail of the component of FIG. 3, drawn to a still larger scale, FIGS. 5 and 6 are side views illustrating further constructional details of the equipment shown at different stages of operation, and FIG. 7 is a cut-away perspective view of a further form of equipment.

The equipment shown in the accompanying Figures is for drilling the sea bed and obtaining samples therefrom but, as described hereinafter, it can be modified so as to be capable of effecting in-situ testing at the sea bed. The drilling and sampling equipment of the Figures includes a drill tube 1 made-up of sections screwed and jointed at suitable positions to facilitate assembly of internal components. The tube 1 is supported in an upright position by a framework mast 2, support plates 3 to which the upper end of the tube 1 is secured carrying guide rollers 4 that run on uprights 2A of the mast 2. A chain and pulley mechanism 5 is provided for raising and lowering the assembly of the tube 1 and its support plates 3.

Referring to FIG. 2, at its lower end the drill tube 1 has a base plate 6 having cutting bits 7 bolted to its underside. The drill tube 1 is connected at its upper end to a swivel bearing unit 8 that allows the passage of drilling fluid into the drill tube and the passage of hydraulic oil services to components within the drill tube. A coupling 9 serves for the transmission of rotational power to the swivel unit 4 from a drive motor 10 mounted on the upper of the two support plates 3. This motor 10 thus moves up and down the mast 2 with the tube 1, drawn by the chains 5A of the chain and pulley mechanism 5, which chains are secured to the plates 3. During such movement the rollers 4 run on the frame uprights 2A which can be of rectangular section as illustrated in FIG. 1 or of circular section as illustrated in FIG. 2.

Also shown in FIG. 2 is a hydraulic ram 11 mounted within the drill tube 1 parallel to the central axis of the drill tube 1 but offset therefrom. This ram 11 is supported by a plate 12 fast with the curved wall of the drill tube 1.

Now referring to FIG. 3, centrally of the ram support plate 12 are bushings 13 which form an upper mounting for a shaft 14 that is coaxial with the tube 1, a lower mounting for this shaft being formed by similar bushings in the tube base plate 6. The shaft 14 has secured to it by means of keys or similar fixings a cassette 15 that contains core sampling tubes 16. This cassette includes a series of tubes 15A disposed radially about the central shaft 14 and held by upper and lower suitably drilled plates 15B which are fixed by keys to the axial shaft 14 as just mentioned. It is to be noted that only three of these tubes 15A have been shown in FIG. 3, the rest having been omitted in the interests of clarity.

Referring next to FIG. 4, there is shown in this Figure mechanism for rotating the cassette 15 in dependence upon upward motion of the hydraulic ram 11. This mechanism is mounted between the ram support plate 12 and a further plate 17 held spaced below the plate 12 by pillars 18. Mounted on the further plate 17 is a fulcrum post 19 carrying a pivot pin 20 at its free end that mounts a pair of side-by-side bellcrank levers 21. Bell ends 21A of one arm of each of these levers 21 engage between fixed flanges 22A of a collar 22 which is slidably mounted on the shaft 11A of the hydraulic ram 11. A compression spring 23 around the shaft 11 acts between the shaft 12 and the upper of the two flanges 22A to return the collar and the levers to their original positions after upward motion of the ram is reversed.

Pivotably connected to the free ends of the other arms of the levers 21 is a thrust link 24 in turn pivotably connected between corresponding ends of a pair of side-by-side curved levers 25 attached by a mounting pivot intermediate the lever ends to the underside of the ram support plate 12. At their other ends the curved levers 25 are pivotably connected to an adjustable stroke link arm 26 having portions suitably screwed together such that its body length can be changed to select the effective angular displacement of a ratchet plate 27 to which it is attached through a pivot.

The ratchet plate 27 is pivotably mounted on the central shaft 14 and carries a spring loaded pawl that co-operates with a detent wheel 29 which is mounted fast for rotation with the shaft 14. The spring loaded pawl 28 is appropriately positioned so that its touch engages the detent wheel 29 driving it with the shaft 14 and cassette 15 rotationally about the axis of the shaft 14 as the result of upward movement of the hydraulic ram and the resulting action of the linkage 22/21/24/25/26/27.

Further independently mounted on the underside of the ram support plate 12 is a detent retainer block 30 holding a spring loaded detent pin 31. The function of this block and pin is to hold the detent wheel 29, shaft 14 and cassette 15 upon completion of the motion of the linkage, thereby allowing the mechanism to return to its start position and the pawl to engage the next notch of the detent wheel.

Turning to FIG. 5, there is mounted in each cassette tube 15A one of the core sampling tubes 16, which is retained in the position illustrated in FIG. 5 by balls 32 forced, in this position, into a groove 33 in the wall of the tube 15A by a shoulder 34A of a valve head slide 34 which is acted upon by a spring 35 mounted about the shank of a valve head 36. The valve head 36 is retained in position by screws 37. Retention of the valve head slide 34 is maintained by the central enlarged headed pin 38 and a circlip 39.

When the valve head slide 34 is acted upon by an external force to cause downward movement to be imparted to the valve head slide 34, a zone 42 between the slide shoulder 34A and a collar 34B of the slide 34 is moved down to align with the groove 33 in the wall of the cassette tube 15A and continued downward movement causes the balls 32 to be forced into the zone 42 (see FIG. 6) thereby releasing the retention of the whole sample tube and valve head assembly from its normal location within the cassette tube 15A.

Screwed into the lower portion of the valve head 36 is a valve seating 40 with which co-operates, within the valve head, a ball valve 41.

Also shown in FIG. 5 is a tong holder 43 having fingers 44 pivotably mounted on a retaining pin 45 and loaded by a spring 46 into a gripping condition. This tong holder 43 has a threaded portion 43A screwed to the shaft 11A of the hydraulic ram 11. The tong holder 43 is shown in FIG. 5 in its uppermost position located within a cylindrical sleeve 47 which is fixed to the underside of the plate 17. The tong fingers 44 by virture of their shape are held open against the closing force of the compression spring 46 whilst located within the cylindrical sleeve 47. The lower portion of the tong holder 43 extends below the bottom extent of the tong fingers 44 for contacting the collar 34B of the valve head slide 34 upon commencement of a sampling operation.

Reverting to FIG. 1, the framework mast 2 is mounted on a chassis 48, braced by wires 49. Also mounted on the chassis 48 is a pump 51 for supplying environmental water as a drilling fluid, and a pressure pot 52 containing electric/hydraulic controls, recording devices and other equipment. Mounted near the foot of the mast 2 is a power hoist 53 for driving the chain and pulley mechanism 5 to raise and lower the drill tube 1. A hoist wire 54 is shackled to the top of the mast 2 for raising the whole equipment to the surface. Power can be supplied either by an underwater power unit mounted on the chassis 48, or by hydraulic or electric power from the surface via an umbilical.

In operation the equipment is lowered to the sea bed so that it rests thereupon as illustrated in FIG. 1. The cassette 15 is disposed so that the hydraulic ram 11 is disposed, in its retracted condition, for co-operation with a first of the cassette tubes 15A, which is thus disposed at a sampling station, the core sampling tube 16 within this tube being in its upper position held by the balls 32 (FIG. 5).

Whilst running the motor 10 so as to rotate the drill tube 1, running the hoist unit 53 to operate the chain and pulley mechanism 5 to lower the rotating drill tube, and operating the pump 51 to pump environmental water through the drill tube (this water passing through ports 55 in the plates 12 and 17 and in the drill tube base plate 6 to flush cuttings away from the cutting bits 7), commencement of a sampling operation is effected by initiating downward motion of the hydraulic ram 11. As this ram motion continues the upper portions of the tong fingers 44 move from the confinement of the cylindrical sleeve 47 and the lower portions of the tong fingers 44 close about the head of the pin 38 at the top of the sampling tube 16 in question, forming a secure lock about this pin 38 as the lower portions of the fingers 44 move into the confinement of the cassette tube 15A in which the tube 16 is disposed. The base of the tong holder 43 engages the valve head slide 34 forcing the slide down to release the balls 32 from the groove 33 in the wall of the cassette tube 15A and with further downward motion of the ram 11 the sampling tube 16 is forced to project from its cassette tube 15A.

When the sampling tube 16 makes contact below the level of the drill bits 7 with the soil to be sampled, drilling fluid contained within the sampling tube is permitted to pass out of this tube through the ball valve 41 and galleries 56 (in the valve head shank) and 57 (in the valve slide shoulder), allowing the sampled soils to pass into the sampling tube.

The downward stroke of the hydraulic ram 11 is terminated by a hydraulic pressure signal to the control mechanism (contained for example in the pot 52), and upward motion of the ram 11 is initiated. As the sampling tube 16 rises the ball valve 41 closes to assist the retention of the core sample within the sampling tube. As the balls 32 reach the level of the groove 33 the spring 35 asserts itself towards the shoulder 34 to force the balls outwardly into the groove 32. Then the tong fingers 44 are opened by their upper portion striking and entering the cylindrical sleeve 47 and as they are no longer confined within the cassette tube 15A at their lower ends they disengage from the pin 38.

Thus, in operation, the force imparted by the hydraulic ram 11 in its downward movement acts upon a sampling tube held within the cassette pushing this sampling tube downward to retrieve a soil sample from below the drill tube, and subsequent upward motion of the ram 11 lifts this sampling tube back into the cassette. The final stage of the upward motion of the ram is imparted to the collar 22 when the upper portion of the tong holder 43 engages this collar and lifts it, compressing the spring 23. As the collar 22 is lifted the bell ends 21A of the levers 21 are moved upwards and thus is actuated the linkage 22/21/24/25/26/27. The rotary motion thus imparted to the ratchet plate 27 is transferred to the shaft 14 by the pawl 28 which engages the notched detent wheel 29 thus rotating the shaft 14 and cassette 15. Upon completion of this motion the detent pin 31 engages the detent wheel 29 to hold it in position against rotation in the reverse direction when the pawl 28 subsequently moves in the reverse direction when the hydraulic ram next moves down and the spring 23 asserts itself to re-set the linkage 22/21/24/25/26/27. The rotation thus imparted to the cassette 15 is such as to place the next cassette tube 15A and the sampling tubes 16 which it contains at the sampling station aligned with the ram 11.

Thus a series of samples can be obtained, one in each sampling tube of the cassette, at successive levels in a bore hole formed by one downward run of the drill tube 1, successive sampling tubes being automatically presented for retrieving these samples as drilling progresses. The intervals at which undisturbed samples are taken can either be predetermined and automatically arranged as the drill bit reaches the desired depth, or controlled from the surface as the work progresses.

The connections between the drilling and sampling equipment when below water and attendant hoists and personnel are flexible and should the work be carried out from a floating craft there is no need for extensive mooring or other systems to maintain the craft in a precise location.

If desired equipment for providing air rather than water as a flushing medium can be provided.

As so far described, the equipment is brought to the surface for the samples obtained to be recovered and tested. Alternatively, all or some of the sampling tubes can be replaced by in-situ testing devices, such as a penetrometer, adapted to suit the latching tong fingers 44 so that it is this device or these devices that is/are projected into the ground from the cassette. In the case of a penetrometer a measurement of the resistance to penetration may be measured at the hydraulic ram by the fluid pressure developed or other means, thus giving an in-situ test result.

FIG. 7 shows a form of the equipment in which a penetrometer is provided in addition to a full set of sampling tubes as already described. Insofar as the equipment of FIG. 7 corresponds with the equipment of FIG. 1 to 6 the same reference numerals are used again in FIG. 7.

In the form of FIG. 7 a double acting hydraulic ram 58 is centrally mounted above the support plate 12 held fast by a further support plate 59 and tie bars 60. This ram 58, which may be brought into operation in conjunction with the hydraulic ram 11 that actuates the sampling tubes 16, is in the form of a hydraulic cylinder with piston rods protruding from each end. The lower 58A of these rods passes co-axially through a hollow shaft 14A replacing the shaft 14 of the equipment of FIGS. 1 to 6. The rod 58A extends the whole length of the shaft 14A and carries at its lower end a penetrometer consisting of a sliding sleeve 61 carrying a conical point 62. The upper piston rod 58B of the hydraulic ram 58 is connected to an instrument package 63.

The instrument package 63 is held and supported within guide rods 64 depending from a top support plate 65 (having a port 55A for flushing water), and is connected to the penetrometer 61/62 via electric cables which pass centrally through the ram piston rods 58B/58A. When the hydraulic ram 58 is brought into operation, simultaneous movement of the penetrometer 61/62 and the instrument package 63 occurs. This movement is recorded within the instrument package through information transmitted to a battery powered digital recording system. This system will record simultaneously the successively changing data given off from electrical strain gauges mounted within the penetrometer cone 62 and sleeve 61, and the relative position of the hydraulic ram 58. This positional information is obtained from a potentiometer connected to a chain wheel 65 which is caused to turn, as the instrument package and penetrometer move, by the resultant motion of a chain 67 extending between the plates 59 and 64.

Motion is imparted to the hydraulic rams 58 and 11 in the following way. Hydraulic hoses 68 feed a sequential control valve system 69. When drilling has achieved the required depth at which sampling may occur, hydraulic signals are fed via the control hoses 68 to the valve system 69 to initiate downward movement of the centrally mounted penetrometer operating ram 58. This downward movement causes the instrument package 63 to move from its initial position under the top plate 65, releasing a switch 70 to energise the digital recording system contained within the instrument package. Continued downward movement eventually causes hydraulic pressure to rise within the upper portion of the operating cylinder of the ram 58. This pressure rise is sensed by the valve system 69, which operates to cause hydraulic supply fluid to be fed to the ram 11 to effect sample tube feeding as already described, alongside the penetrometer 61/62. When full hydraulic resistance is sensed, that is sample tube driving has been completed, the hydraulic flow is switched to the lower portion of the operating cylinder of the ram 56 to effect withdrawal of the penetrometer. Upon completion of the upward movement, the hydraulic ram 56 operates the valve system 69 to permit oil to flow to the ram 11 thereby withdrawing the operated sample tube back into the cassette and finally causing the cassette to turn ready for the next operation.

The penetrometer instrument package 63 is switched off at the completion of the upward stroke of the ram 56 when the isolating switch 70 again abuts the top support plate 65. The port 55A for flushing water in the top plate 65 is also utilised for connecting an electrical cable (not shown) to a plug 71 at the top of the instrument package 63 so that information stored within the digital memory of the instrument package may be transferred to a further tape storage unit once the equipment has been returned onboard ship. This information may subsequently be computed and transferred to any convenient recording system.

I claim:

1. Drilling, sampling and testing equipment comprising a drill; a plurality of sample receivers and a testing means mounted for entering with the drill a bore being drilled by the drill, the sample receivers being movable so as successively to be disposed at a sampling station and the testing means being movable to be disposed at a testing station adjacent said sampling station; first means for operating that sample receiver disposed at said sampling station to obtain a sample therein; second means for operating the testing means to effect testing; and third means, arranged to be actuated in dependence upon sample receiver operation effected by said first means to move the so-operated sample receiver with its obtained sample away from said sampling station and to move the next successive sample receiver to said sampling station whereby samples can be obtained by successive sample receivers at successive levels in a bore hole during drilling of the bore hole; said second means being operable such that sampling and testing can be carried out at the same time.

2. Equipment as claimed in claim 1, wherein the individual sample receivers of said plurality of such receivers are disposed in a circular array and said first means is disposed such that it is brought into operative association with each of these individual receivers in turn by step-by-step relative rotation of the array and the first means.

3. Equipment as claimed in claim 2, wherein the individual sample receivers are mounted in a rotatable cassette, and wherein said first means is a hydraulic ram arrangement disposed to be placed in alignment with each individual receiver in turn by step-by-step rotation of the cassette.

4. Equipment as claimed in claim 3, wherein each sample receiver includes a pair of telescopically engaged members, one of these members being fast with said cassette and the other member being retained in a normal withdrawn position by retaining means, said ram arrangement when aligned with any one such receiver being operable to release the retaining means and effect an extension sampling stroke of this other member.

5. Equipment as claimed in claim 4, wherein said ram arrangement acts on said other member via a holder that automatically engages the other member for effecting withdrawal thereof after an extension stroke, said holder automatically releasing said other member at the completion of a withdrawal stroke.

6. Equipment as claimed in claim 5, wherein said testing means is mounted centrally in said cassette, and wherein said second means is in the form of a further hydraulic ram arrangement that is disposed in alignment with said testing means for operating said testing means.

7. Equipment as claimed in claim 6, wherein the further hydraulic ram arrangement and the first-mentioned hydraulic ram arrangement are operatively associated such that a first working stroke of the first-mentioned hydraulic ram arrangement is triggered by a first working stroke of the further hydraulic ram arrangement, this first working stroke of the first-mentioned hydraulic ram arrangement triggers a return working stroke of the further ram arrangement, and this return working stroke of the further ram arrangement triggers a return working stroke of the first-mentioned ram arrangement.

8. Drilling, sampling and testing equipment comprising a drill; a plurality of sample receivers and a testing means mounted for entering with the drill a bore being drilled by the drill, the sample receivers being movable so as successively to be disposed at a sampling station and the testing means being movable to be disposed at a testing station adjacent said sampling station; first means for operating that sample receiver disposed at said sampling station to obtain a sample therein; second means for operating the testing means to effect testing; and third means, arranged to be actuated in dependence upon sample receiver operation effected by said first means to move the so-operated sample receiver with its obtained sample away from said sampling station and to move the next successive sample receiver to said sampling station whereby samples can be obtained by successive sample receivers at successive levels in a bore hole during drilling of the bore hole; said second means being operable such that sampling and testing can be carried out at the same time; wherein the individual sample receivers of said plurality of such receivers are disposed in a circular array and said first means is disposed such that it is brought into operative association with each of these individual receivers in turn by step-by-step relative rotation of the array and the first means; wherein the individual sample receivers are mounted in a rotatable cassette, and wherein said first means is a hydraulic ram arrangement disposed to be placed in alignment with each individual receiver in turn by step-by-step rotation of the cassette; and wherein said second means includes a detent wheel and pawl arrangement and a linkage connected to be actuated by operation of said ram arrangement to effect said step-by-step rotation of said cassette.

* * * * *

UNITED STATES PATENT AND TRADEMARK OFFICE

CERTIFICATE OF CORRECTION

PATENT NO. : 4,043,407

DATED : August 23, 1977

INVENTOR(S) : John William Wilkins

It is certified that error appears in the above-identified patent and that said Letters Patent are hereby corrected as shown below:

Cover page, change the name of the Assignee from "Taywood Seltrust Offshore" to ---Taylor Woodrow Construction Limited and Seltrust Construction Limited---

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*